US006666625B2

(12) United States Patent
Thornton

(10) Patent No.: US 6,666,625 B2
(45) Date of Patent: Dec. 23, 2003

(54) RETAINING WALL SUPPORT POSTS

(76) Inventor: Scott Anthony Thornton, 257 Burri Road, Malua Bay, New South Wales (AU), 2536

( * ) Notice: Subject to any disclaimer, the term of this patent is extended or adjusted under 35 U.S.C. 154(b) by 0 days.

(21) Appl. No.: 10/047,357

(22) Filed: Jan. 14, 2002

(65) Prior Publication Data

US 2002/0067959 A1 Jun. 6, 2002

Related U.S. Application Data

(63) Continuation-in-part of application No. 09/650,982, filed on Aug. 30, 2000.

(30) Foreign Application Priority Data

Aug. 30, 1999 (AU) ..... PQ2524
Dec. 14, 2001 (AU) ..... 4017/01

(51) Int. Cl.[7] ..... E02D 29/02

(52) U.S. Cl. ..... 405/284; 405/285; 405/286; 405/262; 256/65.14; 256/65.02; 256/DIG. 5; 52/165

(58) Field of Search ..... 405/259.1, 258.1, 405/284, 285, 286, 252, 231, 244; 256/DIG. 5, 65.14, 65.02; 47/41.14, 47; 52/155, 165, 156

(56) References Cited

U.S. PATENT DOCUMENTS

| | | | | | |
|---|---|---|---|---|---|
| 196,175 | A | * | 10/1877 | Willcuts | 256/DIG. 5 |
| 391,790 | A | * | 10/1888 | Griswold | 256/DIG. 5 |
| 412,766 | A | * | 10/1889 | Lounsberry | 256/DIG. 5 |
| 512,371 | A | * | 1/1894 | Gunn | 256/65.02 |
| 684,096 | A | * | 10/1901 | Price | 256/47 |
| 1,720,004 | A | * | 7/1929 | Rich | 256/DIG. 5 |
| 2,227,553 | A | * | 1/1941 | Paque | 256/DIG. 5 |
| 3,132,726 | A | * | 5/1964 | Johnson | 52/153 |
| 3,193,255 | A | | 7/1965 | Burdett | |
| 3,728,862 | A | | 4/1973 | Meredith | |
| 3,815,369 | A | | 6/1974 | Meredith | |
| 3,896,596 | A | * | 7/1975 | Berger | 256/47 |
| 3,971,224 | A | | 7/1976 | Elkuch | |
| 4,037,788 | A | | 7/1977 | Riley | |
| 4,269,545 | A | | 5/1981 | Finney | |
| 4,795,137 | A | * | 1/1989 | Witt | 256/DIG. 5 |
| 4,863,137 | A | | 9/1989 | Cockman et al. | |
| 5,104,265 | A | * | 4/1992 | Halloran, Jr. | 405/244 |
| 5,360,296 | A | | 11/1994 | Angelette | |
| 5,636,482 | A | | 6/1997 | Klager | |
| 5,671,484 | A | | 9/1997 | Lee, III | |
| 5,671,584 | A | | 9/1997 | Mueller | |
| 5,730,555 | A | * | 3/1998 | Stoner | 405/259.1 |
| 6,173,945 | B1 | * | 1/2001 | Lindsey et al. | 256/DIG. 5 |

FOREIGN PATENT DOCUMENTS

| | | |
|---|---|---|
| AU | 12612/88 | 9/1988 |
| AU | 54785/96 | 12/1996 |
| AU | 56297/98 | 10/1998 |

(List continued on next page.)

*Primary Examiner*—Heather Shackelford
*Assistant Examiner*—Frederick L Lagman

(57) ABSTRACT

A support post for use in the construction of a retaining wall comprises a single, rigid plate member, the bottom portion of which is pointed so that the plate member can be readily driven into the ground a distance sufficient to ensure minimal movement of the plate member. The upper portion of the plate member has at least one aperture (and preferably several pairs of apertures) in it, through which a bolt, screw or nail may be passed to hold a wall member (for example, a plank) firmly against the plate member. If the plate member is roll formed from steel sheet, it will normally have ridges or folds to improve its stiffness. A spike may extend below the plate member, and a rod may extend upwardly from the top of the plate member and be fitted with a support for a wire, cable, hose or a fence post. A support post for use at corners of a retaining wall has two half-plate members welded to a steel rod with an included angle of up to 90°.

22 Claims, 5 Drawing Sheets

FOREIGN PATENT DOCUMENTS

| | | | | |
|---|---|---|---|---|
| GB | 2129845 | * | 5/1984 | ..... 256/DIG. 5 |
| GB | 2248643 | | 4/1992 | |
| GB | 2280688 | | 2/1995 | |
| WO | WO 93/19266 | | 9/1993 | |
| WO | WO 95/29313 | | 2/1995 | |
| WO | WO 99/20846 | | 4/1999 | |

* cited by examiner

RETAINING WALL SUPPORT POSTS

CROSS REFERENCE TO RELATED APPLICATION

This application is a continuation-in-part of patent application Ser. No. 09/650,982 filed Aug. 30, 2000, now abandoned.

TECHNICAL FIELD

This invention concerns garden landscaping. More particularly, it concerns support posts for use in the construction of retaining walls and/or fences used in garden landscaping.

BACKGROUND OF THE INVENTION

Conventional practice in garden landscaping when erecting retaining walls is to construct the retaining wall or walls using bricks, or stones, and mortar. If the retaining wall does more than simply form the edge of a garden bed, it is an inherently expensive structure and takes a considerable time to erect. Consequently, large retaining walls are usually permanent garden structures.

To facilitate the construction of such large retaining walls, special bricks or blocks have been proposed. Recent examples of such bricks or blocks are described in the specification of the U.S. Pat. No. 5,456,555 (angular building blocks); in WIPO Publication No. WO 95/23897 (the specification of International patent application No. PCT/US95/02543-modular wall block system); and in the specification of Australian patent No. 665,923 (interlocking bricks).

Large retaining walls are also constructed using heavy timber. In Australia, treated logs and so-called "railway sleepers" have been used in garden landscaping. The specification of Australian patent application No. 27444/92 describes landscaping logs adapted to be combined together and fastened to each other to form a retaining wall structure.

Another type of large retaining wall is constructed using boards, panel members, planks or the like positioned between specially shaped posts. For example, posts having a T cross-section are erected along the required line of the retaining wall with the top arm of the "T" aligned with the wall direction and the vertical arm of the "T" at a right angle to the wall direction. Planks, panels, and even logs may then be positioned with their ends abutting (or nearly abutting) the inwardly directed arms of the T-section posts to form a wall. Such retaining wall constructions are featured in, for example, (a) the specification of Australian patent application No. 12612/88 (in which the T-section posts are provided with an elongated base and a vertical plate, to enable earth or other fill to stabilise the frames formed with the T-section posts);

(b) WIPO Publication No. WO 95/13431 (the specification of International patent application No. PCT/AU94/00692, in which the T-section posts are constructed using T-section modular units, with varying lengths of the "vertical" arm of the "T", and are restrained by a footing and a "deadman" anchor arrangement); and (c) WIPO Publication No. WO 84/04768 (the specification of International patent application No. PCT/US84/00781, in which concrete T-posts are assembled with post-tensioning devices and the stability of the retaining wall is achieved with base members onto which soil or other fill is placed).

A similar retaining wall construction uses posts which include a channel member each side of the post. A number of these posts are erected along the required line of the retaining wall. Panel members, planks or the like, each having a length essentially the same as the distance between adjacent posts of the wall, are then mounted with their ends inside the facing channels of adjacent posts. Suitable bracing or anchoring means are provided, then soil or other fill is placed behind the panels or planks. Examples of such constructions are described in the following documents:

1. The specification of U.S. Pat. No. 5,671,584, to John F Mueller. This specification discloses the use of "H-beam" post members, which are post members specially constructed to have a central cavity so that the post members can be placed over respective stakes which have been driven into the ground along the required line of the retaining wall. There is a channel on each side of the "H-beam" post. A retaining wall is constructed by sliding the ends of a plank into the facing channels of adjacent "H-beam" posts, then repeating this procedure with additional planks. If necessary, anchors connected by cables to holes in the "H-beam" posts are used to ensure that the retaining wall remains upright after back-filling.
2. The specification of Australian patent application No. 54785/96, by M. Vincentini and G. Belladonna. This specification discloses a retaining wall constructed by sliding panel members into channels—grooves—in upright post members formed by folding lengths of sheet metal.
3. WIPO Publication No. WO 99/20846 (the specification of International patent application No. PCT/CA98/00961 by Durisol, Inc.). This document describes the construction of a retaining wall with posts that have channels formed by two flanges connected by a web, which are held in position by anchors that are similar to the anchor of Mueller's retaining wall—see the aforementioned specification of U.S. Pat. No. 5,671,584.
4. The specification of Australian patent application No. 81448/75, which describes a sea retaining wall formed using panels—baffle elements—which are inserted into the channels of a series of I-beams that have been driven into the earth, with a series of "earth weight anchoring support elements" extending rearwardly from the baffle elements.
5. The specification of Australian patent No. 697,901, to Armstrong & McGovern Limited of New Zealand. This specification discloses how sheet metal panels are progressively lowered into the grooves of adjacent piles, to form a retaining wall, as the region in front of the retaining wall is excavated.
6. The specification of U.S. Pat. No. 3,193,255 of H. D. Burdett, which describes a channelled post and plank system, to form a fence.

DISCLOSURE OF THE PRESENT INVENTION

The first paragraph of the aforementioned specification of Australian patent application No. 81448/75, filed in May 1975, begins:

> "Prior to the present invention, there have existed numerous complicated and impractical sorts of retaining walls from the standpoint of required strength and durability while concurrently being of simple structure . . . that may be mass produced and shipped and assembled on site, with a minimum of experience . . . "

That statement could well begin the present specification, as a reference to retaining walls used in garden landscaping today.

It is an objective of the present invention to provide a support post for a retaining wall which enables the retaining wall to be constructed more economically, in a significantly shorter time, and with the facility to remove the retaining wall without difficulty or to change the position of the retaining wall should a revised garden landscape be required in the future.

It should be noted that in this specification, including the claims, the terms "upper", "lower", "top", "bottom", "vertical", and other "directional" terms, will be used in the sense that these terms will have when the invention is used in the construction of a retaining wall. In addition, the term "wall member" will mean a generally elongate member, preferably of substantially uniform width, such as a plank or beam (typically, but not necessarily, of wood), having, at least at each end thereof, a flat face, the plane of each flat face being orthogonal to the elongate direction of the member.

The above-mentioned objective is achieved by providing a support post in the form of a plate member which has at least one hole in it through which a bolt, screw or heavy gauge nail can pass to hold a wall member firmly against the plate member. The plate member is pointed at its lower end so that it can be driven into the ground a distance which is sufficient to ensure that the post, when free-standing, will be a rigid and substantially vertical support for the wall member or wall members. The plate member may be formed with at least one stiffening or reinforcing feature, which may be a length of metal rod or angle iron, or may be a fold or ridge, extending the length of the plate member. A spike extending below the point of the plate may be provided, to assist (a) in the penetration of the ground, and (b) in ensuring that the support post is substantially vertical. If such a spike is present, it may be formed integrally with the plate member or it may be bonded to the plate member (for example, by welding).

Thus, according to the present invention, a support post for use in the construction of a retaining wall comprises, in its broadest form, a single rigid, elongate plate member, having a top edge, two side edges and a bottom edge, characterised in that (a) said bottom edge is pointed;

(b) said plate member has a lower plate portion which, when said support post is in use in the construction of a retaining wall, is inserted into the ground;

(c) said plate member has an upper plate portion, extending from the top of said lower plate portion to said top edge, said upper plate portion, when said support post is in use in the construction of a wall, being positioned adjacent to a wall member of said retaining wall; and (d) at least one aperture is provided in said upper plate portion, through which a respective securing means (for example, a bolt, screw or the like) may be passed to secure a wall member of said retaining wall to said plate member.

The point (which may be a chisel point) of the bottom edge may be extended downwardly to form a spike.

Normally, the support post will be symmetrical about an imaginary vertical line extending from the centre of the top edge through the point of the bottom edge, and the side edges will be substantially parallel to each other or downwardly slightly divergent or convergent. However, for decorative purposes, the side edges may be non-linear, and may be smoothly shaped so that it is not always possible to observe where the upper edge of the plate member ends and each side edge begins.

When intended for use at a corner of a retaining wall, the plate of the support post may be non-planar. In this configuration, the plate member will normally comprise two substantially identical "half-plates", each extending from the vertical line of symmetry of the support post. The included angle between the half-plates of the support post need not be a right angle, but should be a right angle when the support post is to be used at a right-angled corner of a retaining wall.

A rod-like extension of the support post above its top edge may be provided. When the support post is symmetrical about a vertical line of symmetry, the rod-like extension will be substantially colinear with the vertical line of symmetry. Such an extension will normally have one or more grooves, or holes, in it, for use in locating a wire, cable or hose that is to be positioned above the retaining wall. Alternatively, the extension may terminate in a threaded boss.

In one embodiment of the support post of the present invention, the plate member is attached to a vertical rod along the vertical line of symmetry. In another realisation of the present invention, two separate "half-plates" are welded to a vertical rod. In these forms of the present invention, the vertical rod will normally extend below the point of the bottom edge of the support post to provide the aforementioned spike, and will be independently pointed at its lowermost end. The rod may also extend upwardly above the top edge of the support post.

If the plate member is roll formed from steel plate, it is preferably formed with a central vertical fold or ridge, to provide extra stiffness to the plate member. A short cylinder may be welded within the ridge or fold, at the top of it to facilitate driving the lower portion of the plate member into the ground. Alternatively, a vertical rod may be positioned (and welded) within the ridge or fold, with an extension below the bottom edge of the plate member, to form a spike.

Several embodiments of the present invention will now be described, by way of example only, with reference to the accompanying drawings.

BRIEF DESCRIPTION OF THE ACCOMPANYING DRAWINGS

DETAILED DESCRIPTION OF THE ILLUSTRATED EMBODIMENTS

Figure 1:
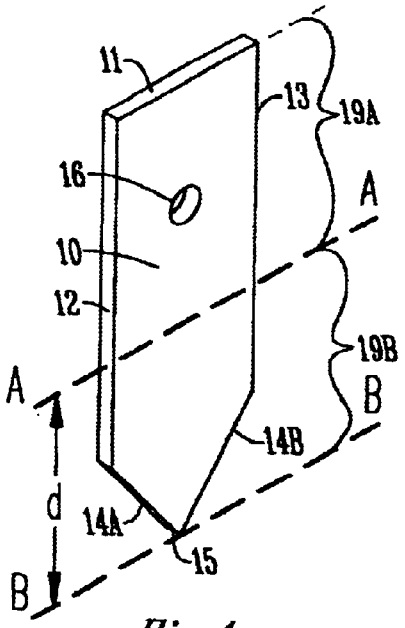
FIG. 1 is a perspective sketch of the most basic support post of the present invention.
Figure 2:
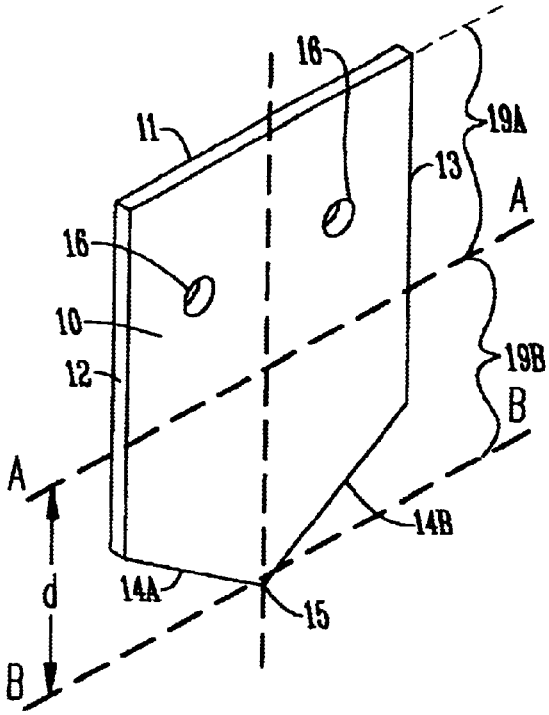
FIG. 2 is a perspective sketch of another basic support post of this invention.

FIGS. 1 and 2 each depict a simple support post consisting of a steel (or other suitable material) plate member 10. The plate member 10 has a top edge 11, side edges 12 and 13, and a bottom edge in two parts 14A and 14B, which meet at a point 15. The plate member 10 contains one hole or aperture 16 (FIG. 1) or one pair of holes or apertures 16 (FIG. 2). The holes 16 in the embodiment illustrated in FIG. 2 are equidistant from the upper edge 11; they are also equidistant from the point 15 and, consequently, they are equidistant from the vertical line of symmetry 20 of the plate member 10.

The plate members shown in FIGS. 1 and 2 are intended to be used in the construction of a low retaining wall comprising a single plank of wood. (A retaining wall of this construction is suitable for use as the edge of a flower bed.) The plate member 10 is driven into the ground a distance d. The distance d is the distance between two imaginary lines AA and BB. The portion of the plate member 10 which is above the line AA constitutes an upper plate portion 19A. The portion of the plate member 10 which is between the lines AA and BB constitutes a lower plate portion 19B.

When the lower plate portion 19B of the plate member of FIG. 1 has been driven into the ground, a plank of wood may be placed against one of the flat surfaces of the upper plate portion 19A. When the lower plate portion 19B of the plate member 10 of FIG. 2 has been driven into the ground, the ends of two planks of wood can be aligned adjacent to the upper plate portion 19A with abutting ends positioned substantially at the vertical line of symmetry 20. A respective screw, bolt, nail or other suitable securing means can then be passed through the, or each, hole 16 and into (or through) the adjacent plank or plank end, to hold the plank or plank ends in contact with the plate 10. When the plank or the other ends of the planks have been suitably supported elsewhere, soil (or other fill, such as gravel, or chips, or stones, or mulch) can be deposited to a depth up to the width of the plank or planks.

Figure 3:
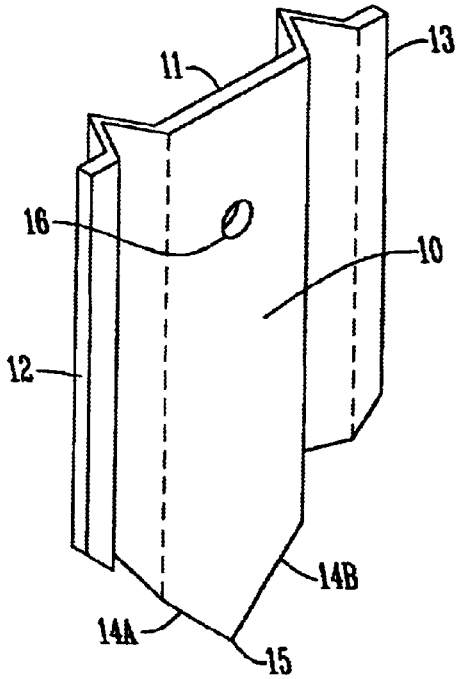
FIG. 3 is a perspective sketch of a modified form of the support post illustrated in FIG. 2.

The support post shown in FIG. 3 is a modified form of the support post illustrated in FIG. 2. The embodiment of FIG. 3, when intended for the construction of a low retaining wall at the edge of a flower bed, may be made from a high density plastic material (for example, a polycarbonate material) or it can be roll formed from steel sheet. It contains two ridges or folds 50, 51, which act as stiffening or strengthening ribs which prevent unwanted flexing of the plate member. The ridges 50, 51 need not be at the side edges of the plate member; they can be nearer to the vertical line of symmetry of the plate member. In fact, they can be replaced with a single, central ridge or fold at the vertical line of symmetry, as in the embodiment illustrated in FIGS. 4 and 5.

Figure 4:
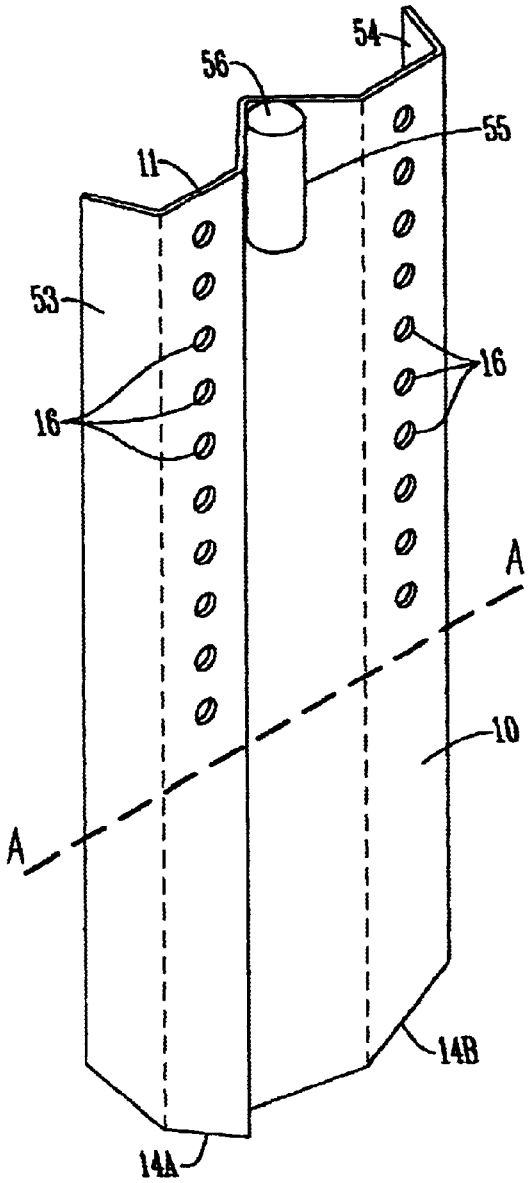
FIG. 4 is a perspective sketch of another support post constructed in accordance with the present invention, having a roll formed plate member.
Figure 5:
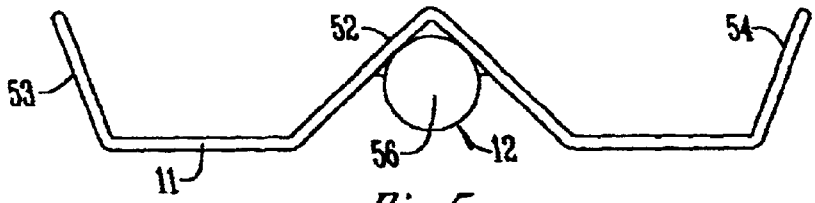
FIG. 5 is a top view of the support post illustrated in FIG. 4.

The plate member of the support post of FIGS. 4 and 5 will normally be made from steel plate by a roll forming process. This embodiment has a single vertical ridge or fold 52 and the regions 53 and 54 of the plate member which are adjacent to the side edges are folded to provide further stiffening. It is intended for use when the retaining wall to be built is somewhat higher than that which can be constructed using a support post shown in FIGS. 1, 2 and 3.

The ridge or fold 52 is shown as generally V-shaped in cross-section, for this shape is believed to be a convenient shape to produce with a roll forming operation. However, ridges which are U-shaped, or semi-circular in cross-section, or which have a cross-section that is three sides of a rectangle, are among the alternative shapes for this feature. A solid steel cylinder (or a length of pipe forming an open-ended cylinder) 55 is welded into the fold or ridge 52, with the end 56 of the cylinder or pipe 55 substantially coplanar with the top edge 11 of the plate member. With this arrangement, a hammer impacting on the top of the ridge 52 and also on the end 56 of the cylinder (or length of pipe) 55 can be used to drive the bottom edge of the plate member into the ground without risk of damage to the top edge of the plate member.

Figure 6:
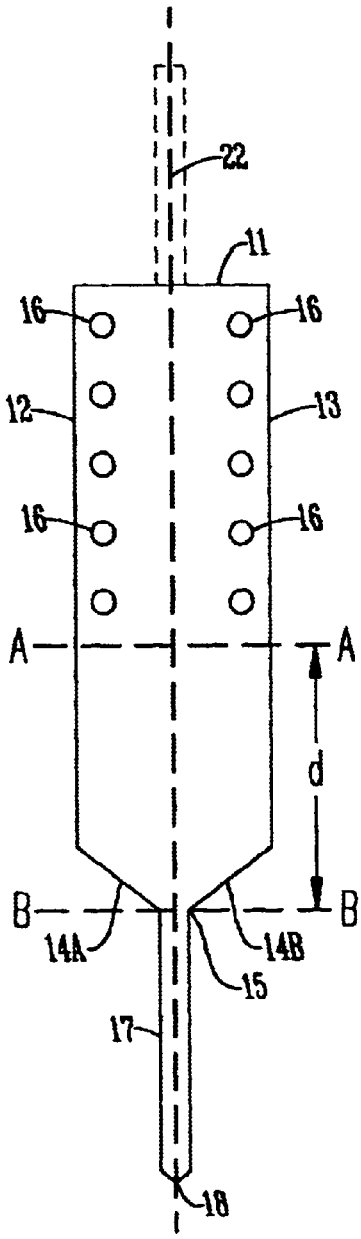
FIG. 6 is a front view of another modified form of the support post illustrated in FIG. 2.

The support post illustrated in FIG. 6 is constructed from a single piece of steel plate or other suitable material. This support post is also intended for use when the retaining wall to be built is somewhat higher than that which can be constructed using a support post as shown in FIG. 1, 2 or 3. In addition to being a taller support post, with several pairs of holes or apertures 16, the plate member 10 of FIG. 3 has a downwards extension from the point 15 to form a spike 17, which terminates in a point 18. It should be apparent that, depending on the width of the planks, two or three planks (or alternative form of wall member) of a retaining wall can be supported on each half of the support post, with the respective opposed ends of each plank (or other wall member) abutting at the vertical line of symmetry 20 of the plate member.

FIG. 6 also shows, in dashed outline, a rod-like upward extension 22. The extension 22, if appropriately grooved, or with at least one hole drilled through it, can be used to support a wire, a cable or a hose above the retaining wall, as will be explained in more detail later in this specification. A length of angle iron or metal rod (not shown in FIG. 6) may be welded to the plate member (for example, along the vertical line of symmetry of the plate member) to prevent flexing of the plate member when the support post is used in a retaining wall.

Figure 7:
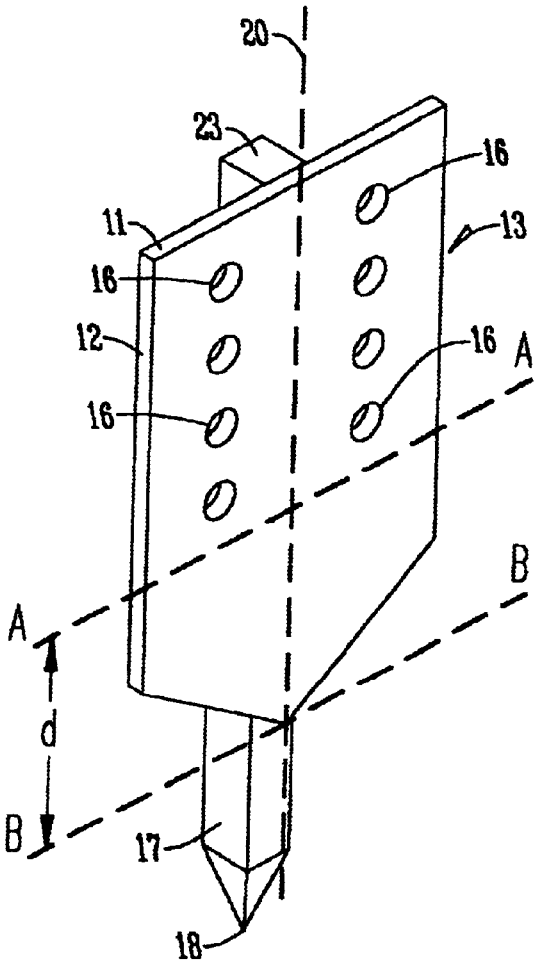
FIG. 7 is a perspective sketch of a different construction of a support post having similar features to the support post of FIG. 6.

The support post illustrated in FIG. 7 has a plate member similar to (but taller than) that shown in FIGS. 1 and 2, with a metal rod 23 of rectangular cross-section welded to it, along the vertical line of symmetry 20 of the plate member. The rod 23 extends below the point 15 of the plate member 10 to form a spike 17 with its point 18.

The support post shown in FIG. 8 has two "half-plates" 10A and 10B welded to diametrically opposed regions of a steel rod 24 of circular cross-section, the rod 24 extends below the point at the junction of the lower edges 14A and 14B of the half-plates 10A and 10B, to form a spike 17 with its own point 18.

Figure 8:
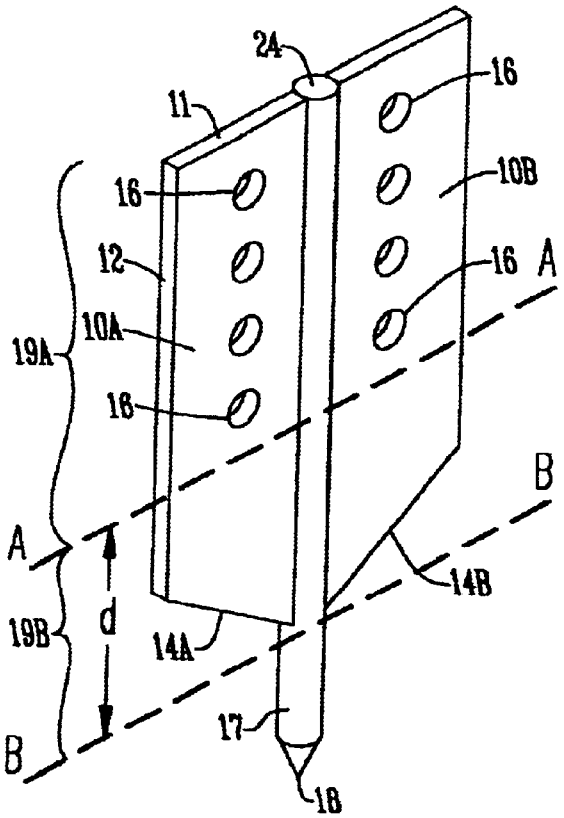
FIG. 8 depicts an alternative construction of a support post having similar features to the support post of FIG. 7.
Figure 9:
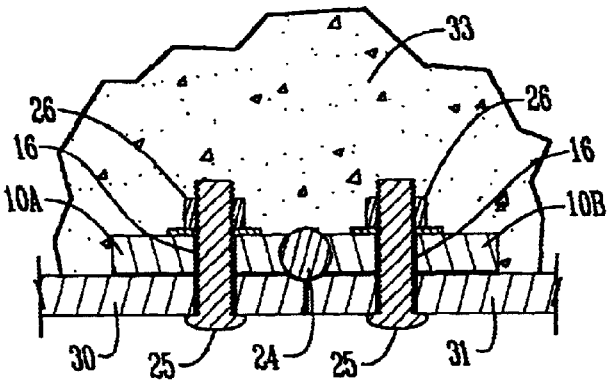
FIG. 9 is a sectional view through a portion of a retaining wall constructed using the support post illustrated in FIG. 8.

FIG. 9 illustrates a typical retaining wall structure, created using planks 30 and 31 supported by a support post constructed as shown in FIG. 8. After driving the lower plate portion 19B of the support post into the ground the required distance d, the planks 30 and 31 are positioned adjacent to the half-plates 10A and 10B with the ends of the planks abutting (or almost abutting) each other. A chamfer on the end of each plank may be required to enable the ends of the planks to abut against each other and then be held firmly against the respective faces of their respective adjacent half-plates 10A and 10B using bolts 25 (which pass through the planks and the holes or apertures 16 in the half-plates) and nuts 26. When soil or other fill 33 is deposited behind the retaining wall, the support plate will not be readily visible, as one face of each half-plate is covered by the soil 33 and the other face of each half-plate is covered by the abutting ends of the planks 30 and 31.

Figure 10:
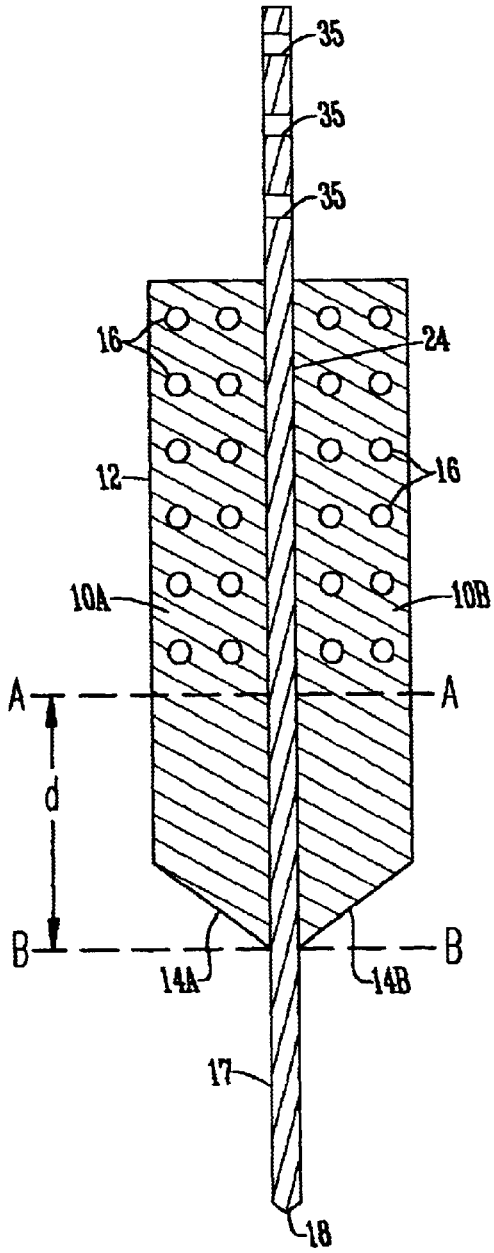
FIG. 10 is a vertical section view through another form of the support post constructed in accordance with the present invention.

In some gardens, it may be desirable to support a wire (or more than one wire) above a retaining wall. Alternatively, or in addition, it may be advantageous to support a hose of a watering system, or an electrical cable (for lighting the garden) above a retaining wall. For this purpose, the support post of the present invention may be constructed with an integral rod-like upward extension, as suggested in the description of the embodiment illustrated in FIG. 6 of the accompanying drawings. Another support post with an upward rod-like extension is shown in FIG. 10. In the FIG. 10 embodiment, two half-plates 10A and 10B are welded to a central steel rod 24 which has a lower spike portion 17 and an upper extension 34, with apertures or holes 35 drilled through it. In a modified form of the support post shown in FIG. 10, the apertures 35 are replaced with grooves or slots, appropriately dimensioned. A wire, cable or hole may be passed through an aperture 35, if the aperture is appropriately dimensioned, or a known support means for a wire, cable or hole may be attached to the aperture 35 or an alternative groove or slot.

Figure 11:
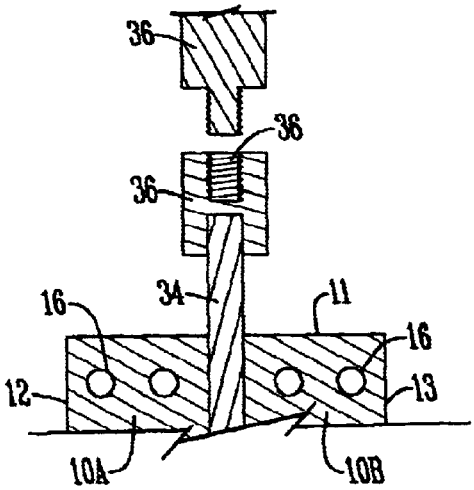
FIG. 11 is a vertical section through part of a modified form of the support post shown in FIG. 10.

FIG. 11 depicts the top of the upper plate portion of the embodiment illustrated in FIG. 7, but with a short extension 34 to which a boss 36 is affixed. The boss 36 has an internally threaded bore or cavity 37 into which the threaded lower end of a post 38 may be screwed. The post 38 may be a fence-post (for example, a post used in the construction of a swimming pool fence).

A metal rod having a length which is longer than the plate member, and having a cross-section that enables it to be fitted into the groove or ridge 52, may replace the cylinder or length of pipe 55 of the support post shown in FIGS. 4 and 5, to produce another realisation of a support post with a spike extending below the junction of the lower edges of the plate member. Such a metal rod may also extend vertically above the top edge 11 of the roll-formed plate member 10 of the embodiment of FIGS. 4 and 5, in which case the metal rod may be provided with support means for a wire, a cable, a hose or a post, similar to the support means featured in the embodiments of FIGS. 10 and 11.

Figure 12:
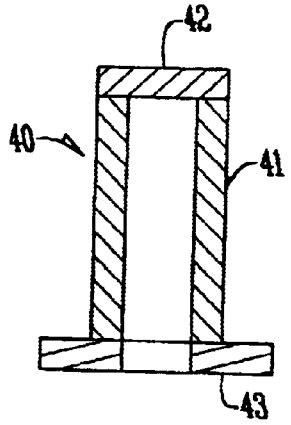
FIGS. 12 and 13 are sectional views through tools which may be used when support posts as illustrated in FIGS. 10 and 11 above are driven into the ground.

To drive the support post shown in FIGS. 6 (with the extension 22), 10 and 11 into the ground without risk of damage to the upwards extension above the plate member of the support post, a generally cylindrical protective sleeve 40, as shown in FIG. 12, may be used. The sleeve 40 has a cylindrical body 41, a closed top 42 and an annular foot member 43. Typically the body 41, top 42 and foot member 43 will be of steel, and will be welded together to form a rigid sleeve 40. In use, the sleeve 40 is placed over the extension 34 with the foot member 42 resting on the top edge 11 (actually, two half-edges 11) of the half-plates 10A and 10B and with the top 42 clear of the top of the extension 22 or 34. By striking the top 42 of the protective sleeve, impact pressure is applied to the half-plates 10A and 10B and the support post is driven into the ground.

Figure 13:
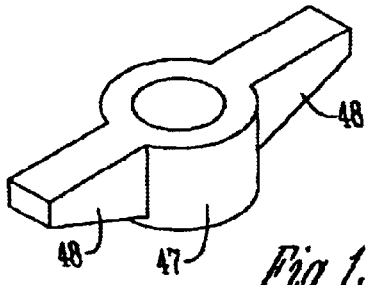

An alternative tool for driving the lower plate portions of the support posts shown in FIGS. 6, 10 and 11 into the ground is illustrated in FIG. 13. This alternative tool comprises a cylindrical foot member 47 having an annular cross-section, with a pair of diametrically opposed arms 48 welded to or formed integrally with the foot member 47. With the foot member 47 surrounding the extension 22 or 34, this tool may be moved manually so that the foot member 47 impacts on the top edge (or half-edges) 11 to drive the support post into the ground.

Figure 14:
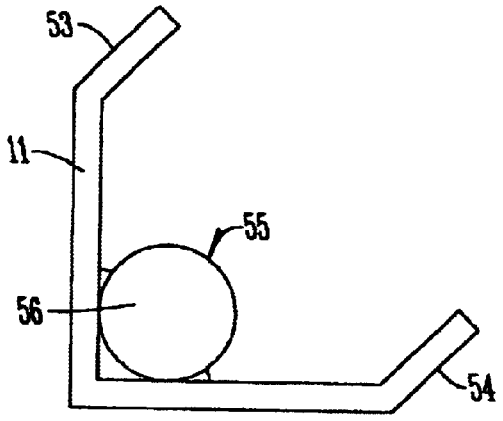
FIG. 14 is a top view (similar to FIG. 5) of a modified form of the support post depicted in FIGS. 4 and 5.

A landscape gardener may be asked to construct a retaining wall which has a corner (or more than one corner) in it. If that is the case, and the wall is to be constructed using the present invention, it will be desirable to have a support post at the (or each) corner of the retaining wall. For this purpose, the support post of FIGS. 4 and 5, modified as shown in FIG. 14, may be used. The support post shown in FIG. 8, with appropriate modification, can also be used to produce a corner support post for a retaining wall. Such a corner support post, with planks 30A, 30B, 31A and 31B of a retaining wall, is featured in FIG. 15 of the accompanying drawings.

Figure 15:
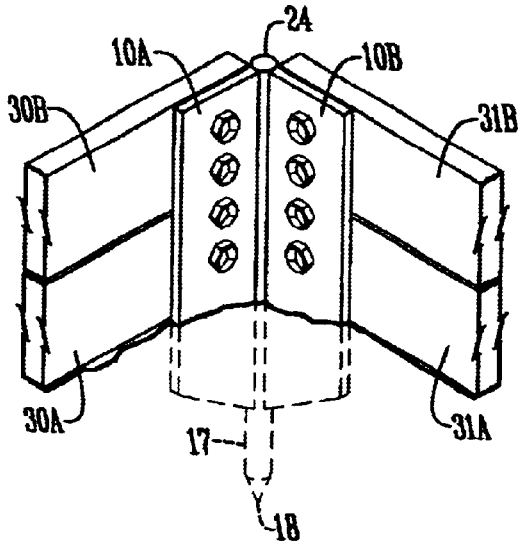
FIG. 15 depicts a corner of retaining wall which has been constructed using a corner support post in accordance with the present invention.

It should be apparent that the support post shown in FIG. 15 has two half-plates 10A and 10B which are not coplanar, but are welded to a "central" rod 24 so that they include an angle of approximately 90°. It should also be apparent that it is a straightforward task to make a support post for a retaining wall with any required included angle by welding two half-plates to a metal rod.

A basic form of a support post for use at a corner of a low retaining wall is a support post similar to that shown in FIG. 2, with the plate member 10 bent about the vertical line of symmetry 20, to form two half-plates with the required included angle for the corner.

Figure 16:
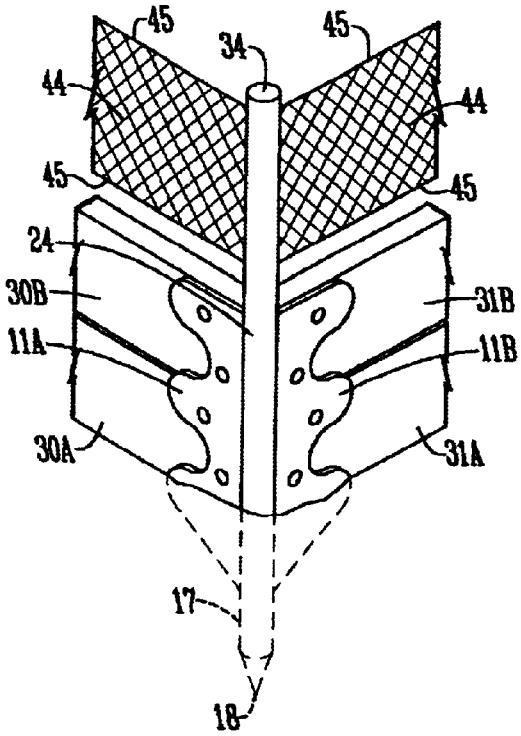
FIG. 16 is a sketch of a corner of a retaining wall with a mesh fence above it, constructed using a corner support post in accordance with the present invention.

FIG. 16 of the accompanying drawings is a sketch showing a corner of a retaining wall constructed using another form of support post which is also in accordance with the present invention. This support post has decorative half-plates 10A and 10B welded to a single steel rod 24, with an upwards extension 34. Holes or grooves in the extension 34 support two wires 45, which in turn support a strip of wire mesh 44. The retaining wall in FIG. 16 comprises a double layer of treated pine planks 30A, 30B, 31A and 31B.

Figure 17:
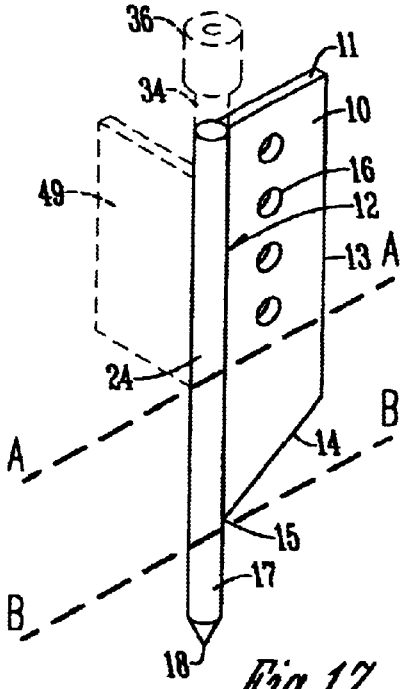
FIG. 17 shows a support post construction which may be used at an end of a retaining wall.

If there is a rock feature, a tree stump, a lamp standard or some other object at or very close to one end of a retaining wall, the retaining wall may terminate without turning a corner. In such a situation, the support post shown in FIG. 17 may be used at a termination of the retaining wall. This support post, which does not have a vertical line of symmetry, comprises a plate member 10 welded to a steel rod 24. The bottom edge 14 of the plate member 10 forms a chisel point 15 with the side edge 12 of the plate member. The rod 24 extends downwards as a spike 17 with a pointed end 18. Optionally, the rod 24 may extend above the top edge 11 of the plate member 10. This optional extension 34 may terminate in a boss 36 having an internally threaded cavity to receive the threaded lower end of a fence post. Another optional feature of the support post shown in FIG. 13 is an end plate member 49, welded to the rod 24 so that the planar faces of the end plate member 49 are at right angles to the planes of the faces of the plate member 10. The end plate member 49, if present, covers the end faces of the planks or other wall members that are fixed to the plate member 10.

It will be apparent from the above description of the illustrated embodiments that the preferred material for construction of the support post of this invention is steel. Initial experiments have shown that the plate member (or the half-plates) of the embodiments illustrated in FIGS. 1, 2, 6, 7, 8, 9, 10, 11, 15, 16 and 17 may conveniently be 5 mm thick mild steel plate, and if the support post has a spike, the spike 17 should have a length of about 100 mm. In addition, to avoid the need for bracing members or anchors attached to the support posts, the steel plate at the level where the upper plate portion meets the lower plate portion should be at least 100 mm wide. In the constructions using a rod 24 of circular cross-section, the rod should be a solid rod of diameter 20 mm. If the support posts of the present invention are used to construct a retaining wall which is more than 300 mm high, the distance d between the point 15 of the plate member (or the half-plates) of the support post and the surface of the ground, when the support post has been driven into position, should be about 300 mm. However, it should be noted that other materials may be used for the support posts of the present invention and other dimensions of parameters of the post embodiments may be adopted, provided the final product support post is effective to support the retaining wall members safely. Included in the other materials that may be used to make the support posts of this invention are a number of aluminium alloys, steel sheet (see the embodiment of FIGS. 3, 4, 5 and 14), other types of steel, other suitable metals and alloys, and (particularly if a low level retaining wall is to be constructed) high density plastic materials (such as polycarbonates) and wood (either hardwood or treated to prevent rotting). This list is not exhaustive. If a plastic material is used, as noted above, the plate member or half-plates will normally be moulded to include strengthening ribs.

Although treated pine planks are the inventor's preferred wall members for use with the support posts of this invention, other wall members may be used to construct a retaining wall. The other wall members include hardwood planks, treated pine logs with their ends shaped to provide at least one flat face which may be secured against a face of a plate member, lengths of sheet metal and lengths of metal decking. This list, also, is not exhaustive.

To protect the wall members of a retaining wall, an elongate, channel-shaped "cap" or cover may be placed over the top wall member. In addition, if steel is used for the present invention, it will be advantageous to coat the support post—or at least the lower plate portion of the support post that will enter the ground—with black tar or another rust-inhibiting compound.

Engineers, gardeners and landscape architects will appreciate that the present invention is not limited to the embodiments illustrated and described in this specification, and that modifications of and variations to the illustrated embodiments may be made without departing from the present inventive concept, as defined by the following claims.

I claim:

1. A support post for use in the construction of a retaining wall, said post comprising a single, rigid, generally planar, elongate plate member, having a top edge, two side edges and a bottom edge, said bottom edge being pointed; characterized in that:

(a) said plate member has a lower plate portion which, when said support post is in use in the construction of a retaining wall, is inserted into the ground;

(b) said plate member has an upper plate portion, extending from the top of said lower plate portion to said top edge, said upper plate portion, when said support post is in use in the construction of a wall, being positioned adjacent to a wall member of said retaining wall;

(c) at least one pair of apertures is provided in said upper plate portion, through each aperture of which a respective securing means may be passed to secure a wall member of said retaining wall to said plate member:

(d) said plate member is symmetrical about a vertical line of symmetry and the apertures of said at least one pair of apertures are positioned symmetrically with respect to said line of symmetry:

(e) an elongate fold or ridge is formed in said plate member at substantially said vertical line of symmetry: and (f) a cylinder is positioned substantially within said single ridge, the upper end of said cylinder being adjacent to and substantially coplanar with said top edge.

2. A support post as defined in claim 1, including at least one additional elongate fold or ridge formed in said plate member, parallel to the elongate direction of said plate member.

3. A support post as defined in claim 1, in which said plate member is roll formed from steel plate and said cylinder is a steel cylinder which is welded to said plate member.

4. A support post as defined in claim 1, in which the regions of said plate member which are adjacent to said side edges are angled relative to the general plane of said plate member to provide additional stiffness to said plate member.

5. A support post as defined in claim 1, in which said plate member is roll formed from steel plate and said cylinder is replaced with a steel rod positioned substantially within said single ridge and welded to said plate member thereto, said steel rod extending below the pointed bottom edge of said plate member to form a spike, the upper end of said steel rod being adjacent to and substantially coplanar with said top edge.

6. A support post as defined in claim 5 in which the regions of said plate member which are adjacent to said side edges are angled relative to the general plane of said plate member to provide additional stiffness to said plate member.

7. A support post as defined in claim 1, in which said plate member is roll formed from steel plate and said cylinder is replaced with a steel rod positioned substantially within said single ridge and welded thereto, said steel rod extending below the pointed bottom edge of said plate member to form a spike, said steel rod also extending upwardly above said top edge of said plate member, the upward extension of said steel rod being provided with at least one support means selected from the group consisting of: a support for a wire, a support for a cable, a support for a hose, and a boss having an internally threaded cavity which is adapted to receive a threaded end of a fence post.

8. A support post as defined in claim 1, in which said plate member is made form steel and the lower plate region is coated with a rust-inhibiting compound.

9. A support post for use in the construction of a retaining wall, said post comprising a single, rigid, generally planar, elongate plate member, having a top edge, two side edges and a bottom edge, said bottom edge being pointed; characterized in that:

(a) said plate member has a lower plate portion which, when said support post is in use in the construction of a retaining wall, is inserted into the ground;

(b) said plate member has an upper plate portion, extending from the top of said lower plate portion to said top edge, said upper plate portion, when said support post is in use in the construction of a wall, being positioned adjacent to a wall member of said retaining wall;

(c) at least one pair of apertures is provided in said upper plate portion, through each aperture of which a respective securing means may be passed to secure a wall member of said retaining wall to said plate member;

(d) said plate member is symmetrical about a vertical line of symmetry and the apertures of said at least one pair of apertures are positioned symmetrically with respect to said line of symmetry; and (e) A spike extends below said plate member, said spike being formed integral with said plate member and being aligned with said vertical line of symmetry.

10. A support post as defined in claim 9, including an upwardly extending rod formed integral with said plate member and being aligned with said vertical line of symmetry, said upwardly extending rod being provided with at least one support means selected from the group consisting of: a support for a wire, a support for a cable, a support for a hose, and a boss having an internally threaded cavity which is adapted to receive a treaded end of a fence post.

11. A support post as defined in claim 9, including an elongate reinforcing member attached to said plate member, the elongate direction of said reinforcing member being substantially parallel to said vertical line of symmetry.

12. A support post as defined in claim 9, in which the width of said plate member at the junction between said upper plate portion and said lower plate portion is at least 100 mm.

13. A support post for use in the construction of a retaining wall, said post comprising a single, rigid, generally planar, elongate plate member, having a top edge, two side edges and a bottom edge, said bottom edge being pointed; characterized in that:

(a) said plate member has a lower plate portion which, when said support post is in use in the construction of a retaining wall, is inserted into the ground;

(b) said plate member has an upper plate portion, extending from the top of said lower plate portion to said top edge, said upper plate portion, when said support post is in use in the construction of a wall, being positioned adjacent to a wall member of said retaining wall;

(c) at least one pair of apertures is provided in said upper plate portion, through each aperture of which a respective securing means may be passed to secure a wall member of said retaining wall to said plate member;

(d) said plate member is symmetrical about a vertical line of symmetry and the apertures of said at least one pair of apertures are positioned symmetrically with respect to said line of symmetry; and (e) a rod is firmly affixed to said plate member and aligned with said vertical line of symmetry, said rod extending below the pointed bottom edge of said plate member to form a spike.

14. A support post as defined in claim 13, in which said rod also extends upwardly above said top edge of said plate member and the upward extension of said rod is provided with at least one support means selected from the group consisting of: a support for a wire, a support for a cable, a support for a hose, and a boss having an internally threaded cavity which is adapted to receive a threaded end of a fence post.

15. A support post for use in the construction of a retaining wall, said post comprising a single, rigid, elongate plate member, having a top edge, two side edges and a bottom edge, said bottom edge being pointed; said plate member having a lower plate portion which, when said support post is in use in the construction of a retaining wall, is inserted into the ground; said plate member having an upper plate portion, extending from the top of said lower plate portion to said top of edge; at least one pair of apertures being provided in said upper plate portion, through each aperture of which a respective securing means may be passed to secure a wall member of said retaining wall to said plate member; characterized in that:

(a) said plate member is symmetrical about a vertical line of symmetry and the apertures of said at least one pair of apertures are positioned symmetrically with respect to said line of symmetry;

(b) said plate member comprises two substantially planar half-plate members, each half-plate member extending from said line of symmetry; and (c) the half-plate member which extends from one side of said vertical line of symmetry is not coplanar with the half-plate member which extends from the other side of said vertical line of symmetry.

16. A support post for use in the construction of a retaining wall, said post comprising a single, rigid, generally planar, elongate plate member, having a top edge, two side edges and a bottom edge, said bottom edge being pointed; characterized in that:

(a) said plate member has a lower plate portion which, when said support post is in use in the construction of a retaining wall, is inserted into the ground;

(b) said plate member has an upper plate portion, extending form the top of said lower plate portion to said top edge, said upper plate portion, when said support post is in use in the construction of a wall, being positioned adjacent to a wall member of said retaining wall;

(c) at least one pair of apertures is provided in said upper plate portion, through each aperture of which a respective securing means may be passed to secure a wall member of said retaining wall to said retaining wall to said late member;

(d) said plate member is symmetrical about a vertical line of symmetry and the apertures of said at least one pair of apertures are positioned symmetrically with respect to said line of symmetry: and (e) said plate member is made of steel and said bottom edge forms a chisel point, whereby one of said side edges is longer than the other of said side edges; and a substantially rectangular plate is welded to said steel rod adjacent to said upper plate portion, the plane of said substantially rectangular plate being at right angles to the plate of said plate member.

17. A support post as defined in claim 16, in which said steel rod extends below the bottom edge of said plate member to form a spike.

18. A support post as defined in claim 17, in which said steel rod also extends upwardly above said top edge of said plate member and the upward extension of said steel rod is provided with at least one support means selected from the group consisting of: a support for a wire, a support for a cable, a support for a hose, and a boss having an internally threaded cavity which is adapted to receive a threaded end of a fence post.

19. A support post for use in the construction of a retaining wall, said post comprising a single, rigid, generally planar, elongate plate member, having a top edge, two side edges and a bottom edge, said bottom edge being pointed; characterized in that:

(a) said plate member has a lower plate portion which, when said support post is in use in the construction of a retaining wall, is inserted into the ground;

(b) said plate member has an upper plate portion, extending from the top of said lower plate portion to said top edge, said upper plate portion, when said support post is in use n the construction of a wall, being positioned adjacent to a wall member of said retaining wall;

(c) at least one pair of apertures is provided in said upper plate portion, through each aperture of which a respective securing means may be passed to secure a wall member of said retaining wall to said plate member;

(d) said plate member is symmetrical about a vertical line of symmetry and the apertures of said at least one pair of apertures are positioned symmetrically with respect to said line of symmetry; and (e) said plate member is formed as two half-plates, each half-plate having an inner edge which corresponds to said vertical line of symmetry, each inner edge being welded to a vertical rod which extends below the bottom edge of said plate member as a spike.

20. A support post as defined in claim 19, in which said vertical rod also extends upwardly above said top edge of said plate member and the upward extension of said steel rod is provided with at least one support means selected from the group consisting of: a support for a wire, a support for a cable, a support for a hose, and a boss having an internally threaded cavity which is adapted to receive a threaded end of a fence post.

21. A support post as defined in claim 19, in which said half-plates are not coplanar.

22. A support post as defined in claim 21, in which the plane of one of said half-plates is substantially at right angles to the plane of the other half-plate.

* * * * *

UNITED STATES PATENT AND TRADEMARK OFFICE

CERTIFICATE OF CORRECTION

PATENT NO. : 6,666,625 B2
DATED : December 23, 2003
INVENTOR(S) : Scott Anthony Thornton It is certified that error appears in the above-identified patent and that said Letters Patent is hereby corrected as shown below:

Column 12,
Line 34, cancel the word “late” and insert -- plate --.

Column 13,
Line 1, cancel the letter “n” insert -- in --.

Signed and Sealed this

Ninth Day of March, 2004

JON W. DUDAS
*Acting Director of the United States Patent and Trademark Office*